US011466908B2

(12) United States Patent
Cho et al.

(10) Patent No.: US 11,466,908 B2
(45) Date of Patent: Oct. 11, 2022

(54) OUTDOOR HEAT EXCHANGER AND AIR CONDITIONER HAVING THE SAME

(71) Applicant: LG Electronics Inc., Seoul (KR)

(72) Inventors: Eunjun Cho, Seoul (KR); Pilhyun Yoon, Seoul (KR); Sungheon Ryu, Seoul (KR); Kiwoong Park, Seoul (KR); Jungmin Park, Seoul (KR); Hyungyul Yum, Seoul (KR); Yejin Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 153 days.

(21) Appl. No.: 16/837,469

(22) Filed: Apr. 1, 2020

(65) Prior Publication Data

US 2020/0318870 A1 Oct. 8, 2020

(30) Foreign Application Priority Data

Apr. 2, 2019 (KR) ..... 10-2019-0038353

(51) Int. Cl.
*F25B 13/00* (2006.01)
*F25B 39/00* (2006.01)
(Continued)

(52) U.S. Cl.
CPC ..... *F25B 39/00* (2013.01); *F25B 13/00* (2013.01); *F25B 40/02* (2013.01); *F25B 41/385* (2021.01);
(Continued)

(58) Field of Classification Search
CPC ..... F28D 1/0477; F28D 1/0417; F28D 2021/0068; F28F 2210/02; F28F 1/32;
(Continued)

(56) References Cited

U.S. PATENT DOCUMENTS 5,810,074 A 9/1998 Hancock
2017/0328614 A1* 11/2017 Yokozeki ..... F25B 13/00
2018/0259265 A1* 9/2018 Tokudi ..... F28F 9/262

FOREIGN PATENT DOCUMENTS

JP H09152216 6/1997
JP 2005147482 6/2005
(Continued)

OTHER PUBLICATIONS

Extended European Search Report in European Application No. 20167676.4, dated Aug. 12, 2020, 7 pages.
(Continued)

*Primary Examiner* — Henry T Crenshaw
*Assistant Examiner* — Kamran Tavakoldavani
(74) *Attorney, Agent, or Firm* — Fish & Richardson P.C.

(57) ABSTRACT

A heat exchanger includes heat exchange fins, refrigerant pipes are arranged across the heat exchange fins, and connecting pipes connected to the refrigerant pipes to thereby define refrigerant passages. The connecting pipes include a first pipe portion having a first end connected to one of the refrigerant pipes, a branch pipe portion that is branched from the first pipe portion, that extends parallel to the first pipe portion, and that is connected to another of the refrigerant passages, and a second pipe that is connected to the first pipe portion and that is configured to guide gas-phase refrigerant separated from the refrigerant in the first pipe portion. The second pipe includes an inner insert portion inserted into a second end of the first pipe portion and an outlet portion that extends from the inner insert portion in direction opposite to the second end of the first pipe portion.

19 Claims, 5 Drawing Sheets

(51) Int. Cl.
*F25B 40/02* (2006.01)
*F25B 41/385* (2021.01)

(52) U.S. Cl.
CPC ..... *F25B 2313/02523* (2013.01); *F25B 2400/0417* (2013.01); *F25B 2600/2501* (2013.01)

(58) Field of Classification Search
CPC ..... F28F 9/0246; F25B 39/00; F25B 39/02; F25B 13/00; F25B 40/02; F25B 41/26; F25B 41/39; F25B 41/40; F25B 41/385; F25B 43/00; F25B 2400/13; F25B 2600/2501; F16L 13/0209; F16L 41/021
USPC ..... 62/324.6
See application file for complete search history.

(56) References Cited

FOREIGN PATENT DOCUMENTS

| | | |
|---|---|---|
| KR | 1020080060755 | 7/2008 |
| KR | 1020140044005 | 4/2014 |
| KR | 10-2018-0104416 | 9/2018 |

OTHER PUBLICATIONS

PCT International Search Report in International Application No. PCT/KR2020/004449, dated Jul. 21, 2020, 7 pages (with English translation).

* cited by examiner

OUTDOOR HEAT EXCHANGER AND AIR CONDITIONER HAVING THE SAME

CROSS-REFERENCE TO RELATED APPLICATIONS

This application claims the priority benefit of Korean Patent Application No. 10-2019-0038353, filed on Apr. 2, 2019, the disclosure of which is incorporated herein by reference in its entirety.

TECHNICAL FIELD

The present disclosure relates to an outdoor heat exchanger and an air conditioner having the same, and more particularly, to an outdoor heat exchanger and an air conditioner capable of separating liquid-phase refrigerant and gas-phase refrigerant from a refrigerant flowing therein.

BACKGROUND

An air conditioner may include a compressor, an outdoor heat-exchanger, an expansion device, and an indoor heat-exchanger, and may run a refrigeration cycle to supply cold air or warm air.

For example, during a cooling operation, the outdoor heat exchanger may serve as a condenser for condensing refrigerant, and the indoor heat exchanger may serve as an evaporator for evaporating refrigerant. In the cooling operation, refrigerant may be circulated sequentially through the compressor, the outdoor heat-exchanger, the expander, the indoor heat-exchanger, and the compressor.

In some cases, during a heating operation, the outdoor heat exchanger may serve as an evaporator for evaporating refrigerant and the indoor heat exchanger may serve as a condenser for condensing refrigerant. In the heating operation, refrigerant may be circulated sequentially through the compressor, the indoor heat-exchanger, the expander, the outdoor heat-exchanger, and the compressor.

In some cases, where an outdoor temperature is extremely low and a pressure loss is excessively increased in the outdoor heat-exchanger, a refrigeration system may have difficulty in heating a room.

In some cases, an outdoor heat exchanger may include a path allowing refrigerant to flow and a connecting pipe connected to a curved portion of the path so that gas-phase refrigerant is separated therefrom. In some cases, an air conditioner may include a bypass passage that connects the connecting pipe and an inlet passage of a compressor and that allows the gas-phase refrigerant that has flowed out of the connecting pipe to the inlet passage of the compressor in case of a heating operation.

In some cases, the outdoor heat exchanger may have a U-shaped curved portion of the path, and the connecting pipe may be connected to the U-shaped curved portion. In some cases, where a flow direction of refrigerant along the curved portion is different from a longitudinal direction of the connecting pipe, gas-phase refrigerant may hardly flow into the connecting pipe.

SUMMARY

The present disclosure describes an outdoor heat exchanger and an air conditioner having the same capable of easily installing a pipe that guides gas-phase refrigerant on a pipe that guides two-phase refrigerant.

The present disclosure also describes an outdoor heat exchanger and an air conditioner having the same capable of separating gas-phase refrigerant from a refrigerant passage and moving the separated gas-phase refrigerant along the same direction of the two-phase refrigerant.

The present disclosure further describes an outdoor heat exchanger and an air conditioner having the same capable of improving heating performance by separating gas-phase refrigerant from an outdoor heat exchanger during a heating operation so as to bypass the gas-phase refrigerant to an inlet passage of a compressor even in case of being in a severe cold environment.

Objects of the present disclosure should not be limited to the aforementioned objects and other unmentioned objects will be clearly understood by those skilled in the art from the following description.

According to one aspect of the subject matter described in this application, a heat exchanger includes a plurality of heat exchange fins, a plurality of refrigerant pipes that are arranged across the plurality of heat exchange fins and that are configured to guide refrigerant, and a plurality of connecting pipes that are connected to the plurality of refrigerant pipes to thereby define a plurality of refrigerant passages with the plurality of refrigerant pipes. At least one of the plurality of connecting pipes includes: a first pipe portion having a first end connected to one of the plurality of refrigerant pipes, a branch pipe portion that is branched from the first pipe portion, that extends parallel to the first pipe portion, and that is connected to another of the plurality of refrigerant passages, and a second pipe that is connected to the first pipe portion and that is configured to guide gas-phase refrigerant separated from the refrigerant in the first pipe portion. The second pipe includes an inner insert portion inserted into a second end of the first pipe portion and an outlet portion that extends from the inner insert portion in direction opposite to the second end of the first pipe portion.

Implementations according to this aspect may include one or more of the following features. For example, the heat exchanger may be an outdoor heat exchanger installed outside a predetermined area to be heated such as a room, a house, a building, or the like. In some examples, a diameter of the inner insert portion may be less than a diameter of the outlet portion. In some examples, the inner insert portion may include a taper portion that extends from an end of the outlet portion, wherein a diameter of the taper portion decreases along a direction away from the end of the outlet portion, and a diameter reducing portion that extends from an end of the taper portion, wherein a diameter of the diameter reducing portion is less than the diameter of the outlet portion.

In some examples, the diameter reducing portion may be disposed at a center of the first pipe portion. In some examples, the first pipe portion may include a diameter extension portion that is disposed at the second end of the first pipe portion and that receives a part of the outlet portion.

In some implementations, the inner insert portion may extend toward the branch pipe portion, and a length of the inner insert portion may be greater than a distance between the second end of the first pipe portion and the branch pipe portion. In some examples, the first pipe portion may define a communicating hole that is in communication with the branch pipe portion, and the length of the inner insert portion may be equal to a distance between the second end of the first pipe portion and an inner end of the communicating hole.

In some implementations, the inner insert portion may include an inclined surface that is disposed at an inner end of the inner insert portion and that is inclined with respect to a longitudinal direction of the inner insert portion. In some examples, the inclined surface of the inner insert portion may face a side of the first pipe portion connected to the branch pipe portion.

In some implementations, the first pipe portion may define a communicating hole that is in communication with the branch pipe portion, and a length of the inner insert portion may be greater than a distance between the second end of the first pipe portion and an end of the communicating hole. The inclined surface of the inner insert portion may extend to the first pipe portion inward relative to the end of the communicating hole.

In some implementations, the plurality of refrigerant passages may include a plurality of unit passages that are separated from one another, and each of the plurality of unit passage may include portions corresponding to the first pipe portion, the branch pipe portion, and the second pipe.

According to another aspect, an air conditioner includes a compressor, an expansion device, an indoor heat exchanger, and an outdoor heat exchanger. The outdoor heat exchanger includes a plurality of heat exchange fins, a plurality of refrigerant pipes that are arranged across the plurality of heat exchange fins and that are configured to guide refrigerant, and a plurality of connecting pipes that are connected to the plurality of refrigerant pipes to thereby define a plurality of refrigerant passages with the plurality of refrigerant pipes. At least one of the plurality of connecting pipes includes: a first pipe portion having a first end connected to one of the plurality of refrigerant pipes, a branch pipe portion that is branched from the first pipe portion, that extends parallel to the first pipe portion, and that is connected to another of the plurality of refrigerant passages, and a second pipe that is connected to the first pipe portion and that is configured to guide gas-phase refrigerant separated from refrigerant in the first pipe portion. The second pipe has an inner insert portion inserted into a second end of the first pipe portion and an outlet portion that extends from the inner insert portion in direction opposite to the second end of the first pipe portion. The air conditioner further includes a compressor inlet passage that is configured to communicate the refrigerant from an outlet of the outdoor heat exchanger to an inlet of the compressor during a heating operation, and a first bypass passage that is configured to bypass the gas-phase refrigerant from the second pipe of the outdoor heat exchanger to the compressor inlet passage.

Implementations according to this aspect may include one or more of the following features. For example, the outdoor heat exchanger may include one or more of the features of the heat exchanger described above. In some examples, the compressor inlet passage may include an accumulator configured to separate liquid-phase refrigerant and gas-phase refrigerant, and a first refrigerant passage that is configured to communicate the refrigerant from the outlet of the outdoor heat exchanger to an inlet of the accumulator during the heating operation. The compressor inlet passage may connect an outlet of the accumulator to the inlet of the compressor, and the outdoor heat exchanger is connected to the compressor inlet passage via the first bypass passage.

In some implementations, the air conditioner may further include a cooling and heating switching valve that is configured to switch flow of refrigerant compressed in the compressor between the outdoor heat exchanger and the indoor heat exchanger. In some implementations, the air conditioner may further include a flow control valve that is disposed at the first bypass passage, that is configured to open the first bypass passage in the heating operation, and that is configured to close the first bypass passage in a cooling operation.

In some implementations, the air conditioner may further include a supercooler that is in communication with the first bypass passage and that is disposed at a refrigerant pipe disposed between an outlet of the indoor heat exchanger and an inlet of the expansion device during the heating operation. In some examples, the expansion device may include a first expansion device that is disposed at a refrigerant passage between the outdoor heat exchanger and the supercooler and that is configured to expand the refrigerant having passed through the supercooler during the heating operation, and a second expansion device that is disposed at a refrigerant passage between the indoor heat exchanger and the supercooler and that is configured to expand the refrigerant having passed through the supercooler during a cooling operation.

In some implementations, the air conditioner may further include a second bypass passage that is in communication with the supercooler and that is configured to communicate the refrigerant between the compressor and a refrigerant pipe disposed between the supercooler and the second expansion device. The second bypass passage may be configured to bypass the refrigerant having passed through the supercooler during the heating operation and the cooling operation.

In some examples, the expansion device may further include a third expansion device that is disposed at the second bypass passage and that is configured to expand the refrigerant passing the second bypass passage, and the supercooler may be configured to exchange heat with the refrigerant having been expanded by the third expansion device. In some examples, the supercooler may include a first supercooler that is in communication with the first bypass passage, and a second supercooler that is disposed adjacent to the first supercooler along a flow direction of refrigerant and that is in communication with the second bypass passage.

In some implementations, the first straight pipe portion and the second straight pipe may be arranged coaxially to each other, and thus the second straight pipe may be easily mounted to the first straight pipe portion so that gas-phase refrigerant of two-phase refrigerant flowing through the first straight pipe portion may flow into the second straight pipe. In some examples, the outdoor heat exchanger may have an advantage of separating much gas-phase refrigerant from two-phase refrigerant flowing through a refrigerant passage.

In some implementations, the air conditioner may improve heating performance even in a severe cold environment using a first bypass passage that bypasses gas-phase refrigerant separated from the outdoor heat exchanger to the compressor inlet passage during a heating operation.

It should be understood that advantageous effects according to the present disclosure are not limited to the effects set forth above and other advantageous effects of the present disclosure will be apparent from the detailed description of the present disclosure.

Details of one or more implementations will be described in the detailed description with reference to the accompanying drawings.

DETAILED DESCRIPTION

Figure 1:
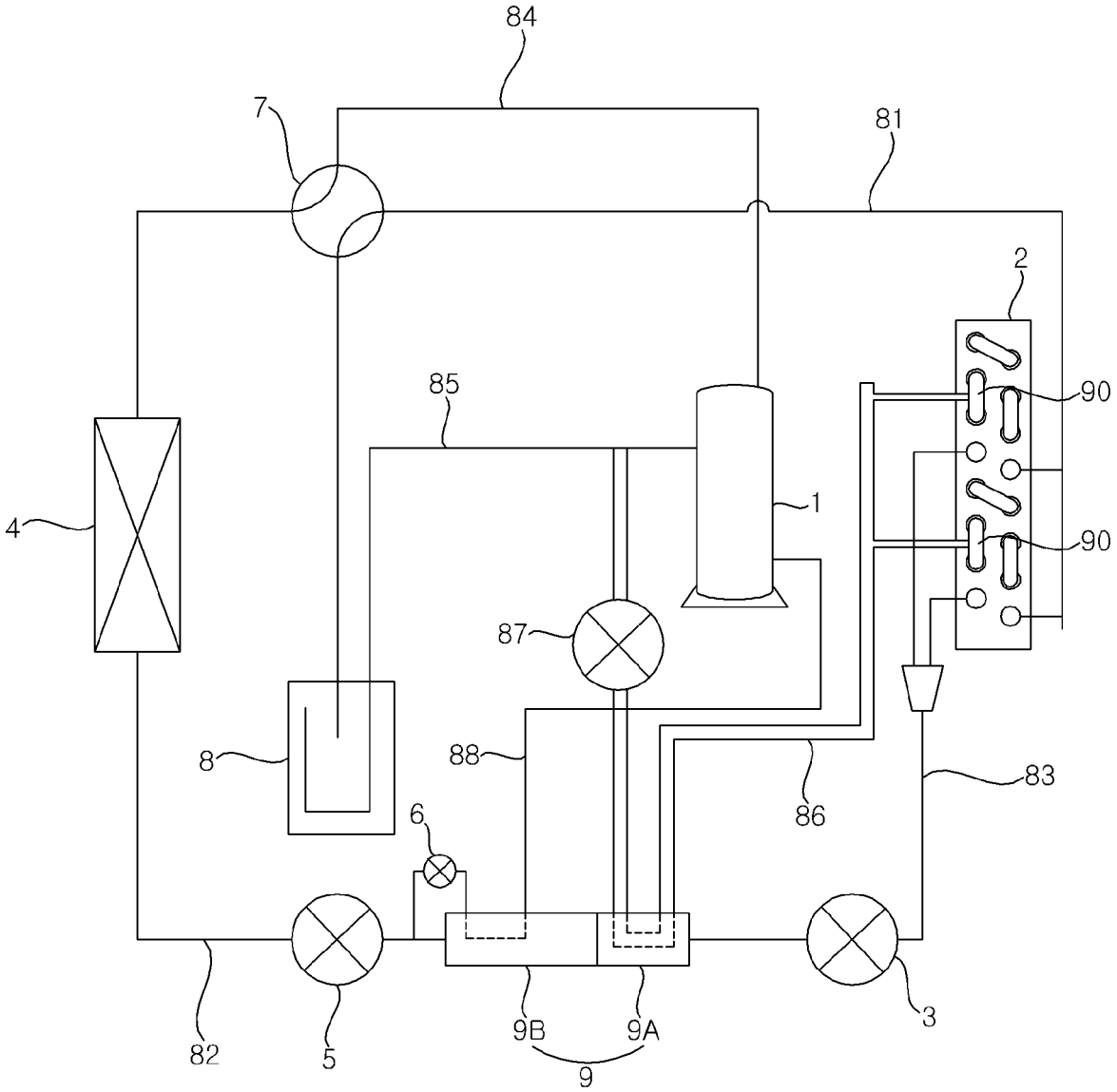
FIG. 1 is a schematic view showing an example of an air conditioner according to the present disclosure.

Advantages and features of the present disclosure and methods of achieving the advantages and features will be apparent with reference to implementations described below in detail in conjunction with the accompanying drawings. However, the present disclosure is not limited to implementations described below, but may be implemented in various forms, only the present implementations are provided so that a disclosure of the present disclosure is complete and a disclosure of a scope of the disclosure is fully understood by those skilled in the art to which the present disclosure belongs, and the present disclosure is only defined by the scope of the claims. The same reference numerals indicate the same components through the specification.

Hereinafter, the present disclosure will be more specifically described with reference the accompanying drawings.

FIG. 1 is a schematic view illustrating an example of an air conditioner according to the present disclosure.

As shown in FIG. 1, an air conditioner may include a compressor 1, an outdoor heat exchanger 2, an expansion device 3, 5 and an indoor heat exchanger 4.

The compressor 1, the outdoor heat exchanger 2, the expansion device 3, 5, and the indoor heat exchanger 4 may be communicated through a plurality of refrigerant passages. For example, the refrigerant passages may include pipes or tubes that are configured to guide refrigerant.

The compressor 1, the outdoor heat exchanger 2, and the expansion device 3, 5 may include an outdoor unit. The outdoor unit may include an outdoor fan for blowing air to the outdoor heat exchanger 2. Outdoor air may flow into the outdoor unit by rotation of the outdoor fan and then the outdoor air may be discharged to outdoor after exchanging heat with the outdoor heat exchanger 2. In some examples, the outdoor heat exchanger 2 may be a first heat exchanger disposed outside a predetermined area to be heated such as a house, a building, a room, or the like.

The indoor heat exchanger 4 may include the indoor unit. The indoor unit may further include an indoor fan for blowing air to the indoor heat exchanger 4. Indoor air may flow into the indoor unit and then the air is discharged to the indoor after exchanging heat with the indoor heat exchanger 4. In some examples, the indoor heat exchanger 4 may be a second heat exchanger disposed inside a predetermined area such as a house, a building, a room, or the like, which may be temperature controlled by a HVAC (heating, ventilation, and air conditioning) apparatus such as an air conditioner and a heater.

The outdoor heat exchanger 2 may serve as a condenser, and the indoor heat exchanger 4 may serve as an evaporator during a cooling operation. For example, refrigerant may be circulated sequentially through the compressor 1, the outdoor heat exchanger 2, the expansion device 3, 5, the indoor heat exchanger 4, and the compressor 1 during the cooling operation.

The outdoor heat exchanger 2 may serve as an evaporator during a heating operation. For example, refrigerant can be circulated sequentially through the compressor 1, the indoor heat exchanger 4, the expansion device 5, 3, the outdoor heat exchanger 2, and the compressor 1 during the heating operation.

The compressor may compress the refrigerant. The condenser may condense refrigerant that has flowed out from the compressor 1. The expansion device 3, 5 may expand refrigerant that has flowed out from the condenser. The evaporator may evaporate refrigerant that has flowed out from the expansion device 3, 5.

The expansion device 3, 5 may include a first expansion device 3 and a second expansion device 5. The first expansion device 3 and the second expansion device 5 may selectively expand refrigerant flowing therein by controlling the opening.

Thus, the second expansion device 5 may be fully opened so as not to expand refrigerant that has flowed out from the indoor heat exchanger 4 during the heating operation, and then the first expansion device 3 may be controlled to be slightly opened so as to expand refrigerant that has flowed out from the indoor heat exchanger 4.

In some implementations, the first expansion device 3 may be fully opened so as not to expand refrigerant that has flowed out from the outdoor heat exchanger 2, and then the second expansion device 5 is controlled to be slightly opened so as to expand refrigerant that has flowed out from the outdoor heat exchanger 2.

In some examples, the first expansion device 3 may be installed at a refrigerant passage disposed between the outdoor heat exchanger 2 and a supercooler 9, and the second expansion device 5 may be installed at a refrigerant passage disposed between the indoor heat exchanger 4 and the supercooler 9. The first expansion device 3 may expand refrigerant that has flowed out from the supercooler 9 during the heating operation, and the second expansion device 5 may expand refrigerant that has flowed out from the supercooler 9 during a cooling operation.

The air conditioner may be an air conditioner capable of being operated in cooling mode and heating mode. At this time, the air conditioner may be an air conditioner capable of being operated only in heating operation.

Hereinafter, an air conditioner capable of being operated in cooling operation and heating operation will be described.

An air conditioner according to the present disclosure may further include a cooling and heating switching valve 7. The cooling and heating switching valve 7 may switch the flow direction of refrigerant that has flowed out from the compressor 1 between the outdoor heat exchanger 2 and the indoor heat exchanger 4.

A compressor inlet passage 81, 8, 85 may communicate an outlet of the outdoor heat exchanger 2 with an inlet of the compressor 1 during a heating operation. The compressor inlet passage 81, 8, 85 may include an accumulator 8 separating liquid-phase refrigerant and gas-phase refrigerant, a first refrigerant passage 81 communicating an inlet of the outdoor heat exchanger 2 with an inlet of the accumulator 8, and a compressor inlet passage 85 communicating an outlet of the accumulator 8 with the inlet of the compressor 1.

In some examples, liquid-phase refrigerant and gas-phase refrigerant may flow into the accumulator 8 via the first refrigerant passage 81 from the outdoor heat exchanger 2 during the heating operation.

In some examples, liquid-phase refrigerant separated from the accumulator 8 may disposed at a lower portion of the accumulator 8, and then gas-phase refrigerant separated from the accumulator 8 may disposed at an upper portion of the accumulator 8.

Gas-phase refrigerant separated from the accumulator 8 may flow into the compressor 1 via the compressor inlet passage 85, and then liquid-phase refrigerant separated from the accumulator 8 may be remained in the accumulator 8.

The second refrigerant passage 82 may communicate an outlet of the indoor heat exchanger 4 during the heating operation with an inlet of the expansion device 3, 5 during the heating operation.

The third refrigerant passage 83 may communicate an outlet of the expansion device 3, 5 during the heating operation with the inlet of the outdoor heat exchanger 2 during the heating operation.

The fourth refrigerant passage 84 may communicate an outlet of the compressor 1 with an inlet of the indoor heat exchanger 4 during the heating operation.

The cooling and heating switching valve 7 may be installed at the first refrigerant passage 81 and the fourth refrigerant passage 84.

A flow of refrigerant during the heating operation of the air conditioner will be as followings.

The following disclosure relates to refrigerant flowing of the air conditioner during the heating operation. Refrigerant compressed in the compressor 1 flows into the cooling and heating switching valve 7 via a front portion of the fourth refrigerant passage 84. The refrigerant that has flowed into the cooling and heating switching valve 7 flows into the indoor heat exchanger 4 via a rear portion of the fourth refrigerant passage 84. Refrigerant that has flowed into the indoor heat exchanger 4 flows into the expansion device 3, 5 via the second refrigerant passage 82. Refrigerant that has flowed into the expansion device 3, 5 flows into the outdoor heat exchanger 2 via the third refrigerant passage 83. Refrigerant that has flowed into the outdoor heat exchanger 2 flows into the cooling and heating switching valve 7 via a front portion of the first refrigerant passage 81. Refrigerant that has flowed into the cooling and heating switching valve 7 flows into the accumulator 8 via a rear portion of the first refrigerant passage 81. Refrigerant that has flowed into the accumulator 8 flows into the compressor 1 via the compressor inlet passage 85. The air conditioner continues to repeatedly keep the refrigerant flow during the heating operation according to the above scheme.

The following disclosure relates to refrigerant flowing of the air conditioner during the cooling operation. Refrigerant compressed in the compressor 1 flows into the cooling and heating switching valve 7 via a front portion of the fourth refrigerant passage 84. Refrigerant that has flowed into the cooling and heating switching valve 7 flows into the outdoor heat exchanger 2 via a front portion of the first refrigerant passage 81. Refrigerant that has flowed into the outdoor heat exchanger 2 flows into the expansion device 3, 5 via the second refrigerant passage 82. Refrigerant that has flowed into the expansion device 3, 5 flows into the indoor heat exchanger 4 via the second refrigerant passage 82. Refrigerant that has flowed into the indoor heat exchanger 4 flows into the cooling and heating switching valve 7 via a rear portion of the fourth refrigerant passage 84. Refrigerant that has flowed into the cooling and heating switching valve 7 flows into the accumulator 8 via a rear portion of the first refrigerant passage 81. Refrigerant that has flowed into the accumulator 8 flows into the compressor 1 via the compressor inlet passage 85. The air conditioner continues to repeatedly keep the refrigerant flow during the cooling operation according to the above scheme.

In some examples, the accumulator 8 may include a reservoir, a case, a container, or a pipe.

In some implementations, a supercooler 9 may be further installed at the second refrigerant passage 82. A first bypass passage 86 may be communicated with the supercooler 9. For example, a portion of the first bypass passage 86 may pass the supercooler 9. In some examples, the supercooler 9 may define a space configured to receive refrigerant to exchange heat with refrigerant in the bypass passages 86, 88. For instance, the supercooler 9 may include a reservoir, a case, a container, or a pipe.

Refrigerant that has flowed through the indoor heat exchanger 4 during a heating operation of the air conditioner may flow into the supercooler 9 via a front portion of the second refrigerant passage 82, and then the refrigerant that has flowed into the supercooler 9 flows into the expansion device 3 via a rear portion of the second refrigerant passage 82 after exchanging heat with refrigerant flowing through the first bypass passage 86 so as to be supercooled. For example, the supercooler 9 may decrease a temperature of refrigerant in a refrigerant pipe passing therethrough. In some cases, the supercooler 9 may define a space that accommodates refrigerant to exchange heat with the refrigerant in the refrigerant pipe passing therethrough.

In some implementations, an air conditioner may further include a second bypass passage 88 communicating the second refrigerant passage 82 and the compressor 1. The second bypass passage 88 may flow through the supercooler 9.

An end of the second bypass passage 88 may be communicated to the second refrigerant passage 82 between the second expansion device 5 and the supercooler 9, and the other end of the second bypass passage 88 may be communicated to the compressor 1.

In some implementations, a third expansion device 6 may be installed at the second bypass passage 88. The third expansion device 6 may expand refrigerant flowing through the second bypass passage 88. Refrigerant flowing through the second bypass passage 88 may exchange heat with refrigerant flowing through the supercooler 9 after being expanded by the third expansion device 6.

In some examples, the supercooler 9 may include a first supercooler 9A communicated with the first bypass passage 86 and a second supercooler 9B communicated with the second bypass passage 88.

The first supercooler 9A and the second supercooler 9B may be arranged adjacently according to flowing direction of refrigerant. The first supercooler 9A may be installed to the rear flow side (i.e., downstream) of the second supercooler 9B according to flowing direction of refrigerant during the heating operation. The second supercooler 9B may be installed to the front flow side of the first supercooler 9A according to flowing direction of refrigerant during the heating operation. The first supercooler 9A may be installed to the front flow side (i.e., upstream) of the second supercooler 9B according to flowing direction of refrigerant during the cooling operation. The second supercooler 9B may be installed to a rear flow side of the first supercooler 9A according to flowing direction of refrigerant during the cooling operation.

The internal volume of the first supercooler 9A may be smaller than the internal volume of the second supercooler 9B. The internal volume of the second supercooler 9B may be larger than the internal volume of the first supercooler 9A.

In some implementations, during a heating operation of the air conditioner, a partial refrigerant that has flowed through the indoor heat exchanger 4 may flow into the supercooler 9 via a front portion of the second refrigerant passage 82, and the other partial refrigerant that has flowed through the indoor heat exchanger 4 may flows into the second bypass passage 88. Then, refrigerant that has flowed into the supercooler 9 may flow into the first expansion device 3 via a rear portion of the second refrigerant passage 82 after exchanging heat with refrigerant flowing through the second bypass passage 88 so as to be supercooled. And, refrigerant that has flowed into the second bypass passage 88 may be expanded in the third expansion device 6 and flows into the compressor 1 after refrigerant that has flowed into the supercooler 9 is supercooled.

In some implementations, a partial refrigerant that has flowed through the outdoor heat exchanger 2 may flow into the supercooler 9 via a rear portion of the second refrigerant passage 82 during a cooling operation of the air conditioner. A partial refrigerant that has flowed through the supercooler 9 may flow into the second bypass passage 88. Refrigerant that has flowed into the supercooler 9 may flow into the second expansion device 5 via a front portion of the second refrigerant passage 82 after exchanging heat with refrigerant flowing through the second bypass passage 88 so as to be supercooled. Then, refrigerant that has flowed into the second bypass passage 88 may flow into the compressor 1 after supercooling refrigerant that has flowed into the supercooler 9.

In some implementations, the outdoor heat exchanger 2 may further include a separator 90 installed respectively at a plurality of unit passages 20, 30, 40, and the separator 90 separates liquid-phase refrigerant and gas-phase refrigerant at the plurality of unit passages 20, 30, 40 respectively during the heating operation.

The separator 90 may be one of a plurality of connecting pipes 80, 90 as described in detail below.

The separator 90 may separate liquid-phase refrigerant and gas-phase refrigerant, and further the separator may be disposed at each front portion, each middle portion, or each rear portion of the plurality of connecting pipes 80, 90.

The air conditioner may further include a separator 90 and the first bypass passage communicated with the compressor inlet passage 81, 8, 85 so as to bypass gas-phase refrigerant separated in the separator 90 to the compressor inlet passage 81, 8, 85 during the heating operation.

The first bypass passage 86 may communicate the separator 90 with the compressor inlet passage 85.

An end of the first bypass passage 86 is divided into a plurality of passages, and the end of the first bypass passage 86 may be communicated with the separator 90 respectively disposed at the plurality of unit passages 20, 30, 40. Thus, the plurality of unit passages 20, 30, 40 may include a first unit passage 20, a second unit passage 30 and a third unit passage 40, and one end of the first bypass passage 86 may be communicated with a separator 90 disposed at the first unit passage 20, wherein the other end thereof may be communicated with a separator 90 disposed at the second unit passage 30, wherein another end thereof may be communicated with the third unit passage 40 among ends of the first bypass passage divided into three.

The opposite end of the first bypass passage 86 may be communicated with a portion adjacent to an inlet of the compressor 1 of the compressor inlet passage 85.

Refrigerant that has flowed into the first bypass passage 86 from the plurality of unit passages 20, 30, 40 during the heating operation may flow into the compressor via the compressor inlet passage 85.

A flow control valve 87 may be installed at the first bypass passage 86 so as to open the first bypass passage 86 in case of heating operation and close the first bypass passage 86 in case of cooling operation. The flow control valve 87 may be opening and closing valve so as to adjust flow rate of refrigerant flowing through the first bypass passage 86 from the plurality of unit passages 20, 30, 40. The flow control valve 87 may be a ball valve provided with a ball opening and closing a passage therein.

Hereinafter, the plurality of unit passages 20, 30, 40 will be referred to as a plurality of refrigerant passages 20, 30, 40 because there may be at least one of them.

Figure 2:
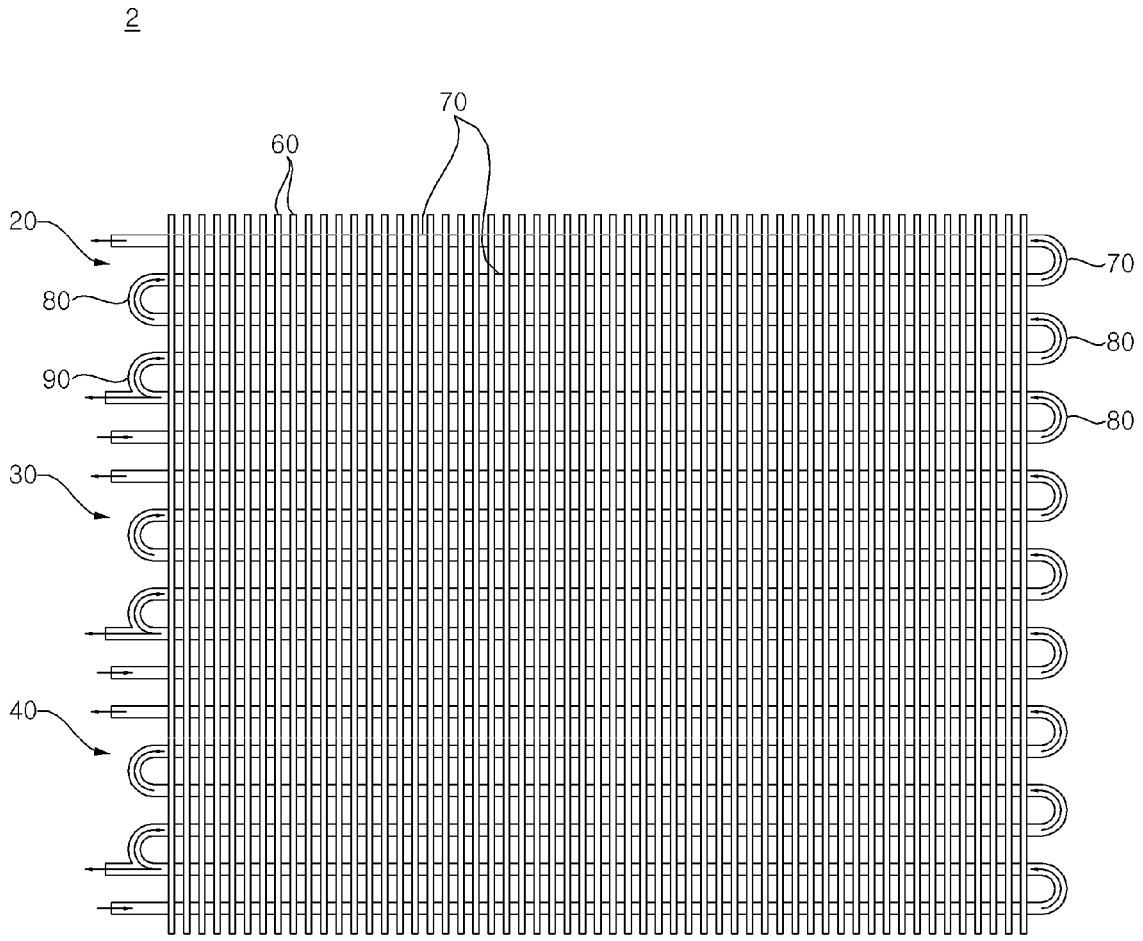
FIG. 2 is a schematic view showing an example of an outdoor heat exchanger of the air conditioner shown in FIG. 1

FIG. 2 is a schematic view showing an example of an outdoor heat exchanger of the air conditioner shown in FIG. 1.

The outdoor heat exchanger 2 may include a plurality of heat exchange fins 60 and refrigerant passages 20, 30, 40.

The refrigerant passages 20, 30, 40 may penetrate the plurality of heat exchange fins 60. Each of the plurality of heat exchange fins 60 may include penetrating holes where refrigerant passages 20, 30, 40 are penetrating. An outer circumference of the refrigerant passages 20, 30, 40 may be contacted to an inner circumference of the penetrating holes in a state that the refrigerant passages 20, 30, 40 are penetrating the penetrating holes.

The plurality of heat exchange fins 60 may increase heat exchange efficiency between refrigerant flowing through a plurality of refrigerant passages 20, 30, 40 and air surrounding the plurality of refrigerant passages 20, 30, 40.

The plurality of heat exchange fins 60 may be square-shaped plate. The plurality of heat exchange fins 60 may be arranged parallel to each other so that each surface of the plurality of heat exchange fins 60 face to each other.

The refrigeration passage 20, 30, 40 may include a plurality of unit passages 20, 30, 40 separated from each other.

The plurality of unit passages 20, 30, 40 may include two unit passages, three unit passages, four unit passages, or more unit passages.

Further, the refrigerant passages 20, 30, 40 may be one refrigerant passage rather than a plurality of unit passages 20, 30, 40 separated from each other.

In case of employing two unit passages, two separators 90 may be disposed at each of two unit passages. Additionally, in case of employing three unit passages, three separators 90 may be disposed at each of three unit passages as shown in FIG. 2.

In some cases, one separator 90 may be at each one unit passage. In some cases, two or more separators 90 may be disposed at each one unit passage. That is, at least one separator 90 may be disposed at each unit passage.

Hereinafter, an outdoor heat exchanger 2 including a plurality of heat exchange fins 60 and one refrigeration passage 20 will be described.

The refrigeration passage 20 may include a plurality of refrigerant straight pipes 70 and the plurality of connecting pipes 80, 90.

The plurality of refrigerant straight pipes 70 may be straight along a longitudinal direction thereof. The plurality of refrigerant straight pipes 70 may be arranged parallel to each other. The plurality of refrigerant straight pipes 70 may penetrate the plurality of heat exchange fins 60. Each of the plurality of heat exchange fins 60 may include penetrating holes where each of the plurality of the refrigerant straight pipes 70 are penetrating. Each outer circumference of the plurality of refrigerant straight pipes 70 may be contacted to each inner circumference of penetrating holes in a state that the plurality of refrigerant straight pipes 70 are penetrating each of the plurality of penetrating holes.

The plurality of connecting pipes 80, 90 communicating a plurality of refrigerant passages 70 may include refrigeration passage 20

The plurality of connecting pipes 80, 90 may include a U-shaped connecting pipe 80 and an h-shaped connecting pipe 90.

The U-shaped connecting pipe 80 may communicate an end of the plurality of refrigerant passages 70 with an end of the plurality of refrigerant passages 70 adjacent thereto.

There may be at least one h-shaped connecting pipe 90. The h-shaped connecting pipe 90 may be the separator 90. Hereinafter, the h-shaped connecting pipe may be referred to as the separator 90.

Figure 3:
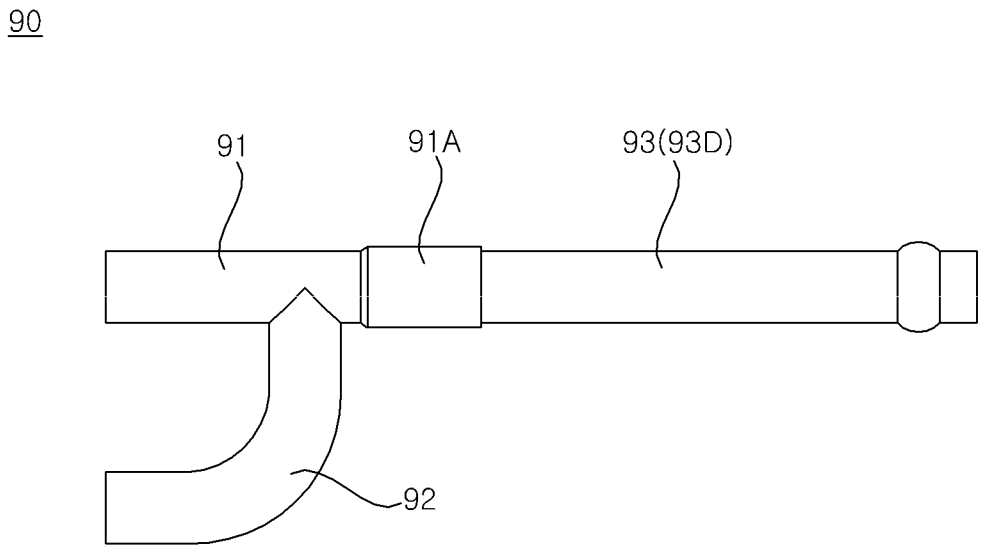
FIG. 3 is a schematic view showing an example of a separator of the outdoor heat exchanger shown in FIG. 2
Figure 4:
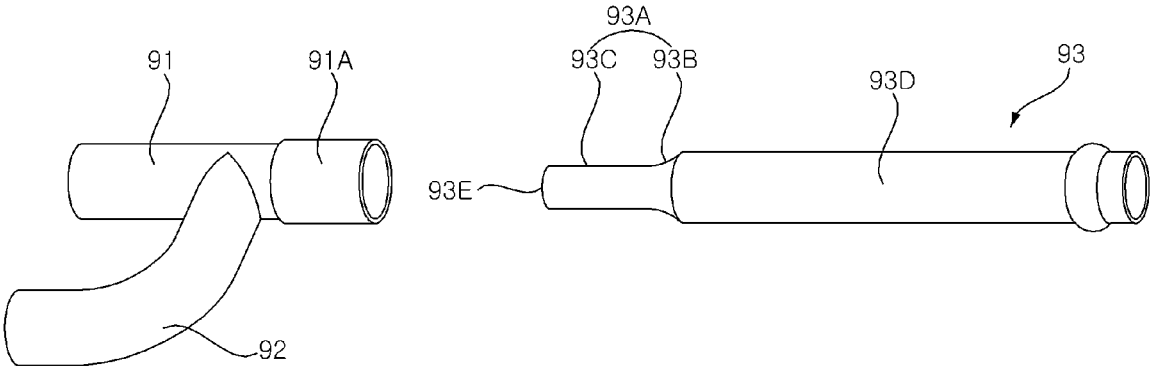
FIG. 4 is a schematic view showing an example of a second pipe that is separated from a first straight pipe portion of the separator shown in FIG. 3
Figure 5:
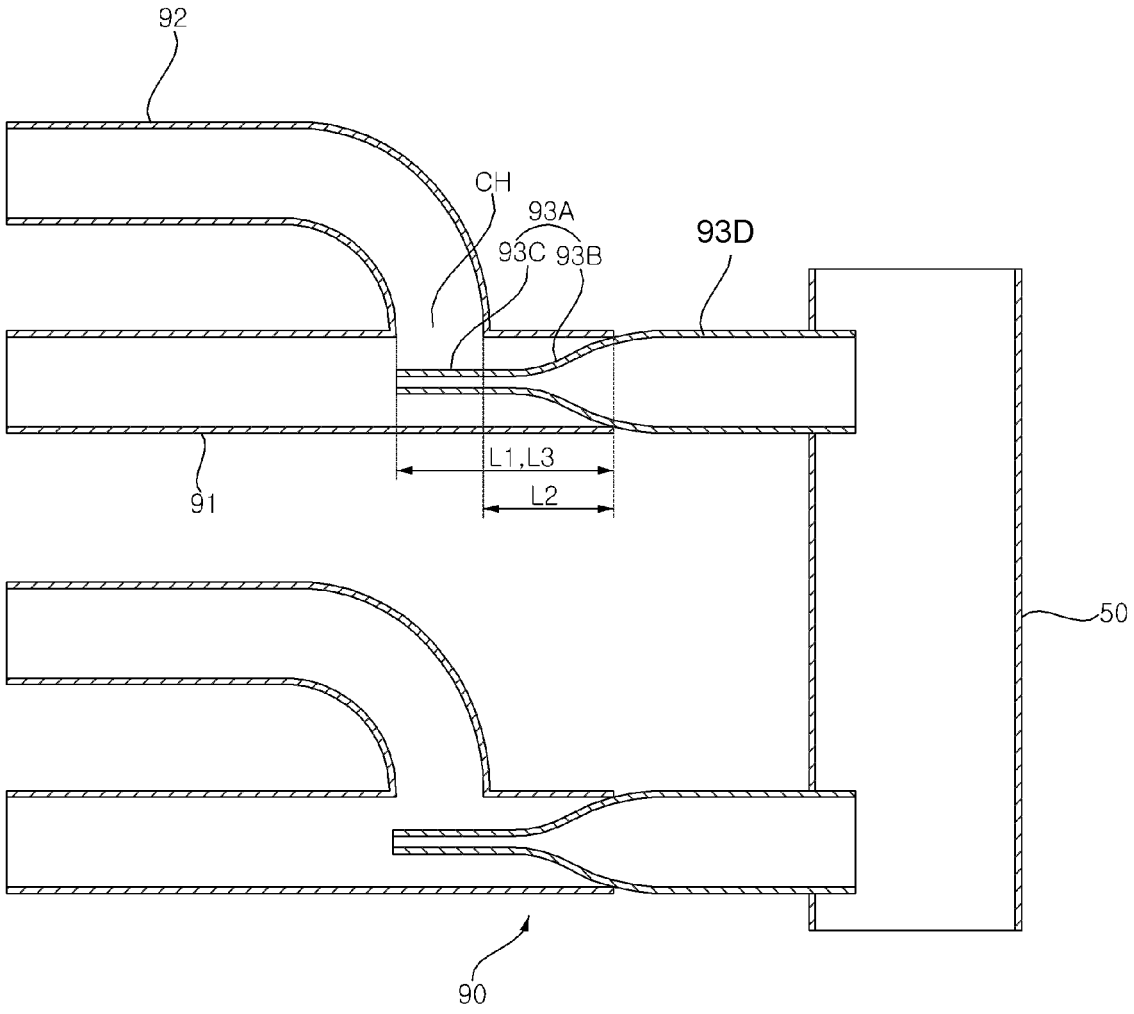
FIG. 5 is a sectional view of the separator shown in FIG. 3.

FIG. 3 is a schematic view showing an example of a separator of the outdoor heat exchanger shown in FIG. 2, FIG. 4 is a schematic view showing an example of a second pipe that is separated from a first straight pipe portion of the separator shown in FIG. 3, and FIG. 5 is a sectional view of the separator shown in FIG. 3.

The separator 90 may include a first straight pipe portion 91, a branch pipe portion 92 and a second straight pipe 93 as shown in FIG. 3 through FIG. 5.

The first straight pipe portion 91 may include an end connected to one of the plurality of refrigerant passages 70, and the branch pipe portion 92 may include an end connected to the other one of the plurality of refrigerant passage 70.

The branch pipe portion 92 may be branched at a side of the first straight pipe portion 91. The branch pipe portion 92 may include an end portion disposed parallel to the first straight pipe portion 91, and the branch pipe portion 92 may be connected to the other one of plurality of refrigerant straight pipes 70. The branch pipe portion 92 may include a curved portion branched at a side of the first straight pipe portion 91 and the other portion having straight portion thereof disposed parallel to the first straight pipe portion 91.

An end of the first straight pipe portion 91 may be connected to an end of two refrigerant straight pipes 70 adjacent to each other, and an end of the branch pipe portion 92 may be connected to one end of the two refrigerant straight pipes 70 adjacent to each other.

The second straight pipe 93 may allow gas-phase refrigerant to be separated from refrigerant flowing through the first straight pipe portion 91.

The second straight pipe 93 may include an inner insert portion 93A and outlet portion 93D.

The inner insert portion 93A may be inserted into an opposite end of the first straight pipe portion 91. The inner insert portion 93A may be disposed the inside of the first straight pipe portion 91. The outlet portion 93D may be extended at the inner insert portion 93A and protruded to the opposite end of the first straight pipe portion 91. The outlet portion 93D may be disposed the outside of the first straight pipe portion 91.

The second straight pipe 93 may be welded to the first straight pipe portion 91 after the inner insert portion 93A is inserted to the other end of the first straight pipe portion 91, and when the welding is finished, the first straight pipe portion 91 and the second straight pipe 93 may be arranged coaxially.

The outlet portion 93D may be connected to the first bypass passage 86. That is, the first bypass passage 86 may connect the outlet portion 93D with the compressor inlet passage 81, 8, 85 so as to bypass gas-phase refrigerant that has flowed through the second straight pipe 93 to the compressor inlet passage 81, 8, 85 during the heating operation.

In a case that the outdoor heat exchanger 2 employs a plurality of separator 90, the outdoor heat exchanger 2 may further include a header 50 connected to the plurality of separator 90. Herein, gas-phase refrigerant that has flowed through the second straight pipe 93 flows into the header 50, and then flows into the first bypass passage 86.

The inner insert portion 93A may have a smaller diameter than that of the outlet portion 93D. As a result of the foregoing, it is possible to prevent the pressure of gas-phase refrigerant that has flowed from the first straight pipe portion 91 to the second straight pipe 93 from being decreased, so as to increase flow rate of the gas-phase refrigerant.

The inner insert portion 93A may include a taper portion 93B and a diameter reducing portion 93C. The taper portion 93B may be extended at an end of the outlet portion 93D. The diameter of the taper portion 93B may be getting smaller as far as being spaced apart from the end of the outlet portion 93D. The diameter reducing portion 93C may be extended at an end of the taper portion 93B. The diameter reducing portion 93C may have a smaller diameter that that of the outlet portion 93D.

The diameter reducing portion 93C may be disposed at a center of the first straight pipe portion 91. Refrigerant that has flowed into the first straight pipe portion 91 may be liquid-phase refrigerant and two-phase refrigerant which is gas-phase refrigerant mixed with liquid-phase refrigerant during the heating operation of the air conditioner. With respect to refrigerant that has flowed into the first straight pipe portion 91 during the heating operation, gas-phase refrigerant may flow through a central portion of the first straight pipe portion 91, and liquid-phase refrigerant may flow along a radial direction from the center of the first straight pipe portion 91.

The diameter of the outlet portion 93D may be the same as that of the first straight pipe portion 91. A diameter extension portion 91A may be disposed at an end of the first straight pipe portion 91. The diameter extension portion 91A may have a larger bore than a portion except for the diameter extension portion 91A of the first straight pipe portion 91.

The inner insert portion 93A extended from the outlet portion 93D may be inserted to the diameter extension portion 91A and welded. That is, the taper portion 93B extended from the outlet portion 93D may be inserted to the diameter extension portion 91A and welded to the diameter extension portion 91A. A part of the outlet portion 93D may be inserted to the diameter extension portion 91A and welded to the diameter extension portion 91A so that the second straight pipe 93 is connected to the first straight pipe portion 91.

A communicating hole CH may be disposed between the first straight pipe portion 91 and the branch pipe portion 92.

The length L1 of the inner insert portion 93A may be larger than a distance L2 between the other end of the first straight pipe portion 91 and the branch pipe portion 92

If the length L1 of the inner insert portion 93A is smaller than the distance L2 between the other end of the first straight pipe portion 91 and the branch pipe portion 92, an end of the diameter reducing portion 93C is disposed rearward relative to the communicating hole CH. Therefore, there may be a problem that gas-phase refrigerant is hardly separated from two-phase refrigerant flowing through the first straight pipe portion 91, and then flows into the branch pipe portion 92.

However, according to an exemplary implementation of the present disclosure, because the length L1 of the inner insert portion 93A is larger than a distance L2 between the other end of the first straight pipe portion 91 and the branch pipe portion 92, an end of the diameter reducing portion 93C is disposed at a portion corresponding to the communicating hole CH. Therefore, gas-phase refrigerant included in two-phase refrigerant flowing through the first straight pipe portion 91 is separated therefrom so as to have flowed into the diameter reducing portion 93C.

The length L1 of the inner insert portion 93A may be the same as the distance L3 between the other end of the first straight pipe portion 91 and an end of the communicating hole CH.

If the length of the inner insert portion 93A is larger than the distance between the other end of the first straight pipe portion 91 and the end of the communicating hole CH, an end of the diameter reducing portion 93C is disposed forwardly compared to a flow direction of the communicating hole CH. In the result of the foregoing, there may be a problem that the diameter reducing portion 93C prevents liquid-phase refrigerant flowing through the first straight pipe portion 91 from having flowed into the branch pipe portion 92.

However, according to an exemplary implementation of the present disclosure, because the length L1 of the inner insert portion 93A is the same as the distance L3 between the other end of the first straight pipe portion 91 and an end of the communicating hole CH, an end of the diameter reducing portion 93C is disposed at an end of the communicating hole CH. Therefore, liquid-phase refrigerant flowing through the first straight pipe portion 91 flows into the branch pipe portion 92 without any disturbance and further gas-phase refrigerant flowing through the first straight pipe portion 91 fully flows into the diameter reducing portion 93C.

The inner insert portion 93A may include an orthotomic surface 93E that is disposed at an end of the inner insert portion 93A and that is disposed perpendicular to the longitudinal direction of the inner insert portion 93A. For example, an end of the diameter reducing portion 93C may include the orthotomic surface 93E disposed perpendicular to the longitudinal direction of the diameter reducing portion 93C.

Figure 6:
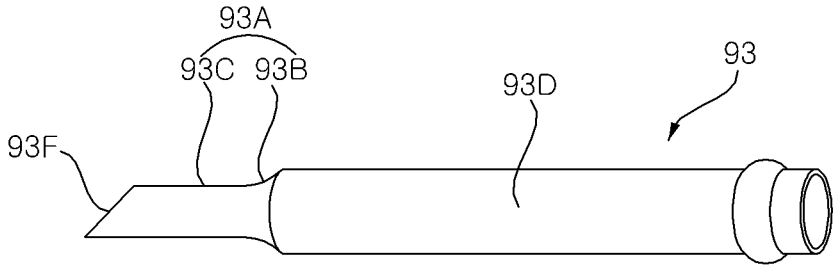
FIG. 6 is a schematic view showing an example of a separator.
Figure 7:
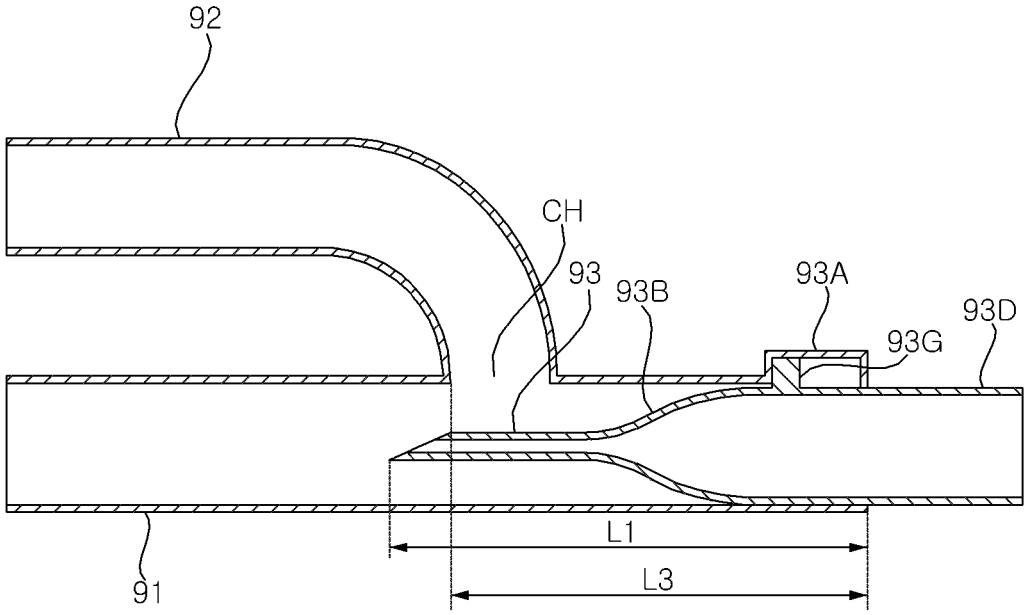
FIG. 7 is a schematic view showing an example of a second straight pipe of the separator shown in FIG. 6

FIG. 6 is a schematic view showing an example of a separator, and FIG. 7 is a schematic view showing an example of a second straight pipe of the separator shown in FIG. 6

Referring to FIG. 6 and FIG. 7, the inner insert portion 93A may include an inclined surface 93F inclined relative to a longitudinal direction of the inner insert portion 93A and disposed at an end of the inner insert portion 93A. In other words, an end of the diameter reducing portion 93C may include the inclined surface 93F inclined relative to the longitudinal direction of the diameter reducing portion 93C.

The length L1 of the inner insert portion 93A may be larger than a distance between the other end of the first straight pipe portion 91 and an end of the communicating hole CH. In this case, an end of the inner insert portion 93A is disposed forwardly compared to the communicating hole CH along a flow direction of refrigerant, and an end of the inclined surface 93F is disposed at a portion corresponding to an end of the communicating hole CH.

In some cases, where a bore of an end of the inner insert portion 93A is smaller than a bore of the inner insert portion 93A, flow rate of gas-phase refrigerant flowing from the first straight pipe portion 91 to the inner insert portion 93A may be decreased due to pressure loss.

In some implementations, the inclined surface 93F is disposed at an end of the inner insert portion 93A. Thus, the diameter reducing portion 93C has a larger inlet area than an area of the diameter reducing portion 93C. Therefore, the present disclosure has an advantage of increasing flow rate of gas-phase refrigerant flowing from the first straight pipe portion 91 to the diameter reducing portion 93C.

The inclined surface 93F may face to a side of the first straight pipe portion 91 branched from the branch pipe portion 92. That is, the inclined surface 93F may face to the communicating hole CH. Therefore, liquid-phase refrigerant flowing through the first straight pipe portion 91 easily flows into the communicating hole CH along the inclined surface 93F so as to prevent liquid-phase refrigerant from having flowed into the diameter reducing portion 93C.

In some implementations, a protrusion portion 93G may disposed at an outer circumference of the second straight pipe 93 and engaged with a step disposed at an end of the diameter extension portion 91A therein. The protrusion portion 93G may be disposed at a boundary between an outer circumference of the outlet portion 93D and an outer circumference of the taper portion 93B.

Since the protrusion portion 93G is engaged with a step disposed at an end of the diameter extension portion 91A therein, it is possible to determine a distance that the inner insert portion 93A is inserted into the first straight pipe portion 91. After the inner insert portion 93A is inserted into the other end of the first straight pipe portion 91 until the protrusion portion 93G is engaged with the step disposed at an end of the diameter extension portion 91A therein, the other end of the first straight pipe portion 91 is welded to the second straight pipe 93.

In some implementations, the outdoor heat exchanger and the air conditioner may have an advantage of easily connecting the second straight pipe 93 to the first straight pipe portion 91, which may increase a flow rate of gas-phase refrigerant of two-phase refrigerant flowing through the first straight pipe portion 91 to the second straight pipe 93. In some examples, the outdoor heat exchanger may separate a large amount of gas-phase refrigerant from two-phase refrigerant flowing through the refrigerant passage 20, 30, 40.

In some implementations, the air conditioner may improve heating performance under a cold condition using a first bypass passage 86 that bypasses gas-phase refrigerant separated from the outdoor heat exchanger 2 to the compressor inlet passage 81, 8, 85 during the heating operation.

What is claimed is:

1. A heat exchanger comprising:

a plurality of heat exchange fins;

a plurality of refrigerant pipes that are arranged across the plurality of heat exchange fins and that are configured to guide refrigerant; and a plurality of connecting pipes that are connected to the plurality of refrigerant pipes to thereby define a plurality of refrigerant passages with the plurality of refrigerant pipes, wherein at least one of the plurality of connecting pipes comprises:

a first pipe portion having a first end connected to one of the plurality of refrigerant pipes, a branch pipe portion that is bent from the first pipe portion and connected to another of the plurality of refrigerant pipes, a portionortion being parallel to the first pipe portion, and a second pipe that is connected to the first pipe portion and that is configured to guide a gas-phase refrigerant separated from the refrigerant in the first pipe portion, the second pipe comprising an inner insert portion inserted into a second end of the first pipe portion and an outlet portion that extends from the inner insert portion in direction opposite to the second end of the first pipe portion, and wherein a diameter of the inner insert portion is less than a diameter of the outlet portion.

2. The heat exchanger of claim 1, wherein the inner insert portion comprises:

a taper portion that extends from an end of the outlet portion, wherein a diameter of the taper portion decreases along a direction away from the end of the outlet portion; and a diameter reducing portion that extends from an end of the taper portion, wherein a diameter of the diameter reducing portion is less than the diameter of the outlet portion.

3. The heat exchanger of claim 2, wherein the diameter reducing portion is disposed at a center of the first pipe portion.

4. The heat exchanger of claim 2, wherein the first pipe portion comprises a diameter extension portion that is disposed at the second end of the first pipe portion and that receives a part of the outlet portion.

5. The heat exchanger of claim 1, wherein the inner insert portion extends toward the first end of the first pipe portion, and a length of the inner insert portion is greater than a distance between the second end of the first pipe portion and the branch pipe portion.

6. The heat exchanger of claim 5, wherein the first pipe portion defines a communicating hole that is in communication with the branch pipe portion, and wherein the length of the inner insert portion is equal to a distance between the second end of the first pipe portion and an inner end of the communicating hole.

7. The heat exchanger of claim 1, wherein the inner insert portion includes an inclined surface that is disposed at an inner end of the inner insert portion and that is inclined with respect to a longitudinal direction of the inner insert portion.

8. The heat exchanger of claim 7, wherein the inclined surface of the inner insert portion faces a side of the first pipe portion connected to the branch pipe portion.

9. The heat exchanger of claim 7, wherein the first pipe portion defines a communicating hole that is in communication with the branch pipe portion, wherein a length of the inner insert portion is greater than a distance between the second end of the first pipe portion and an end of the communicating hole, and wherein the inclined surface of the inner insert portion extends to the first pipe portion inward relative to the end of the communicating hole.

10. An air conditioner comprising:

a compressor;

an expansion valve;

an indoor heat exchanger; and an outdoor heat exchanger comprising:

a plurality of heat exchange fins, a plurality of refrigerant pipes that are arranged across the plurality of heat exchange fins and that are configured to guide refrigerant, and a plurality of connecting pipes that are connected to the plurality of refrigerant pipes to thereby define a plurality of refrigerant passages with the plurality of refrigerant pipes, wherein at least one of the plurality of connecting pipes comprises:

a first pipe portion having a first end connected to one of the plurality of refrigerant pipes, a branch pipe portion that is bent from the first pipe portion and connected to another of the plurality of refrigerant pipes, a portion of the branch pipe portion being parallel to the first pipe portion, and a second pipe that is connected to the first pipe portion and that is configured to guide a gas-phase refrigerant separated from refrigerant in the first pipe portion, the second pipe having an inner insert portion inserted into a second end of the first pipe portion and an outlet portion that extends from the inner insert portion in direction opposite to the second end of the first pipe portion, and wherein the air conditioner further comprises:

a compressor inlet passage that is configured to communicate the refrigerant from an outlet of the outdoor heat exchanger to an inlet of the compressor during a heating operation, and a first bypass passage that is configured to bypass the gas-phase refrigerant from the second pipe of the outdoor heat exchanger to the compressor inlet passage.

11. The air conditioner of claim 10, wherein the compressor inlet passage includes:

an accumulator configured to separate liquid-phase refrigerant and the gas-phase refrigerant; and a first refrigerant passage that is configured to communicate the refrigerant from the outlet of the outdoor heat exchanger to an inlet of the accumulator during the heating operation, wherein the compressor inlet passage connects an outlet of the accumulator to the inlet of the compressor, and wherein the outdoor heat exchanger is connected to the compressor inlet passage via the first bypass passage.

12. The air conditioner of claim 10, further comprising:

a cooling and heating switching valve that is configured to switch flow of refrigerant compressed in the compressor between the outdoor heat exchanger and the indoor heat exchanger.

13. The air conditioner of claim 10, further comprising:

a flow control valve that is disposed at the first bypass passage, that is configured to open the first bypass passage in the heating operation, and that is configured to close the first bypass passage in a cooling operation.

14. The air conditioner of claim 10, further comprising:

a supercooler that is in communication with the first bypass passage and that is disposed at a refrigerant pipe disposed between an outlet of the indoor heat exchanger and an inlet of the expansion valve during the heating operation.

15. The air conditioner of claim 14, wherein the expansion valve comprises:

a first expansion valve that is disposed at a refrigerant passage between the outdoor heat exchanger and the supercooler and that is configured to expand the refrigerant having passed through the supercooler during the heating operation; and a second expansion valve that is disposed at a refrigerant passage between the indoor heat exchanger and the supercooler and that is configured to expand the refrigerant having passed through the supercooler during a cooling operation.

16. The air conditioner of claim 15, further comprising:

a second bypass passage that is in communication with the supercooler and that is configured to communicate the refrigerant between the compressor and a refrigerant pipe disposed between the supercooler and the second expansion valve, the second bypass passage being configured to bypass the refrigerant having passed through the supercooler during the heating operation and the cooling operation.

17. The air conditioner of claim 16, wherein the expansion valve further comprises:

a third expansion valve that is disposed at the second bypass passage and that is configured to expand the refrigerant passing the second bypass passage, and wherein the supercooler is configured to exchange heat with the refrigerant having been expanded by the third expansion valve.

18. The air conditioner of claim 17, wherein the supercooler comprises:

a first supercooler that is in communication with the first bypass passage; and a second supercooler that is disposed adjacent to the first supercooler along a flow direction of refrigerant and that is in communication with the second bypass passage.

19. A heat exchanger comprising:

a plurality of heat exchange fins;

a plurality of refrigerant pipes that are arranged across the plurality of heat exchange fins and that are configured to guide refrigerant; and a plurality of connecting pipes that are connected to the plurality of refrigerant pipes to thereby define a plurality of refrigerant passages with the plurality of refrigerant pipes, wherein at least one of the plurality of connecting pipes comprises:

a first pipe portion having a first end connected to one of the plurality of refrigerant pipes, a branch pipe portion that is bent from the first pipe portion and connected to another of the plurality of refrigerant pipes, a portion of the branch pipe portion being parallel to the first pipe portion, and a second pipe that is connected to the first pipe portion and that is configured to guide a gas-phase refrigerant separated from the refrigerant in the first pipe portion, the second pipe comprising an inner insert portion inserted into a second end of the first pipe portion and an outlet portion that extends from the inner insert portion in direction opposite to the second end of the first pipe portion, and wherein the inner insert portion includes an inclined surface that is disposed at an inner end of the inner insert portion and that is inclined with respect to a longitudinal direction of the inner insert portion.

* * * * *